US008028458B2

(12) United States Patent
Rohrauer

(10) Patent No.: US 8,028,458 B2
(45) Date of Patent: Oct. 4, 2011

(54) HOUSING FOR A RIFLE

(75) Inventor: Hermann Rohrauer, Molln (AT)

(73) Assignee: Steyr Mannlicher Holding GmbH, Kleinraming (AT)

( * ) Notice: Subject to any disclaimer, the term of this patent is extended or adjusted under 35 U.S.C. 154(b) by 0 days.

(21) Appl. No.: 12/066,659

(22) PCT Filed: Jul. 5, 2006

(86) PCT No.: PCT/AT2006/000287

§ 371 (c)(1),
(2), (4) Date: Mar. 13, 2008

(87) PCT Pub. No.: WO2007/030843

PCT Pub. Date: Mar. 22, 2007

(65) Prior Publication Data

US 2008/0190005 A1 Aug. 14, 2008

(30) Foreign Application Priority Data

Sep. 14, 2005 (AT) ..... A 1511/2005

(51) Int. Cl.
*F41A 21/00* (2006.01)

(52) U.S. Cl. ..... 42/75.01; 72/75.02; 72/75.03

(58) Field of Classification Search ..... 42/75.01
See application file for complete search history.

(56) References Cited

U.S. PATENT DOCUMENTS

| | | | | |
|---|---|---|---|---|
| 3,488,488 | A * | 1/1970 | Crouch | 42/146 |
| 3,512,290 | A * | 5/1970 | La Violette, Jr. et al. | 42/75.01 |
| 4,769,938 | A * | 9/1988 | Chesnut et al. | 42/76.02 |
| 5,228,887 | A * | 7/1993 | Mayer | 42/75.02 |
| 6,293,040 | B1 * | 9/2001 | Luth | 42/75.01 |
| 6,487,806 | B2 * | 12/2002 | Murello et al. | 42/75.03 |
| 6,789,342 | B2 * | 9/2004 | Wonisch et al. | 42/75.02 |
| 7,104,000 | B2 * | 9/2006 | Orth | 42/71.01 |
| 7,131,228 | B2 * | 11/2006 | Hochstrate et al. | 42/75.01 |
| 7,219,462 | B2 * | 5/2007 | Finn | 42/49.01 |
| 7,302,881 | B1 * | 12/2007 | Tertin | 89/128 |
| 7,373,868 | B2 * | 5/2008 | Quis | 89/128 |
| 7,444,775 | B1 * | 11/2008 | Schuetz | 42/76.01 |
| 2005/0262752 | A1 * | 12/2005 | Robinson et al. | 42/71.01 |
| 2006/0026883 | A1 * | 2/2006 | Hochstrate et al. | 42/75.01 |
| 2008/0216377 | A1 * | 9/2008 | Rohrauer | 42/75.01 |
| 2009/0019755 | A1 * | 1/2009 | Moretti | 42/75.01 |

FOREIGN PATENT DOCUMENTS

| | | |
|---|---|---|
| FR | 2 573 524 | 5/1986 |
| WO | 03/076863 | 9/2003 |

* cited by examiner

*Primary Examiner* — Michael Carone
*Assistant Examiner* — Samir Abdosh
(74) *Attorney, Agent, or Firm* — Hoffmann & Baron, LLP

(57) ABSTRACT

A housing for a rifle, comprising a first anchoring for a barrel, a second anchoring for a butt, a guide for a breech that can be locked with the barrel, and a seat for a trigger that interacts with the breech. The housing is subdivided into a lower part and a separate upper part which can be firmly connected thereto. The lower part forms the anchorings for the barrel and the butt and the seat for the trigger and the upper part forms the guide for the breech.

20 Claims, 2 Drawing Sheets

HOUSING FOR A RIFLE

BACKGROUND OF THE INVENTION

The present invention relates to a housing for a rifle, having a first anchorage for a barrel, a second anchorage for a stock, a guide for a breech which can be locked to the barrel, and a holder for a trigger which interacts with the breech.

Housings such as these represent the central element of a rifle, supporting the individual assemblies such as the barrel, stock, breech, trigger and magazine, and ensuring that forces are transmitted between these assemblies.

For static and dynamic reasons, the known housings of this type are currently manufactured integrally. At the moment, a specific housing must be developed, manufactured and licensed by the appropriate authorities for the design of different rifle types with different operational requirements, resulting in different assemblies and materials, thus representing a high degree of design, manufacturing, test and logistics effort.

The object of the invention is to overcome the disadvantages of the known designs and to provide a rifle housing which allows a wide range of different types and qualities of rifles to be designed in a simple and cost-effective manner.

SUMMARY OF THE INVENTION

The foregoing object is achieved by a housing of the type mentioned initially which, according to the invention, is distinguished in that the housing is divided into a lower part and an upper part, which is separate from the lower part but can be firmly connected to it, with the lower part forming the anchorages for the barrel and the stock and the holder for the trigger, and with the upper part forming the guide for the breech.

This for the first time provides a housing which allows modular design of a rifle to a very large extent. The invention is based on the discovery that the breech guide of a breech which can be locked directly to the barrel, for example a bolt-action breech, is not subject to the same high mechanical loads as that housing part which transmits forces from the barrel to the stock. Against the background of this discovery, a modular design is achieved, divided into an upper part which guides the breech and a lower part which supports the system. This makes it possible for the first time to provide a multiplicity of different weapon types with a single lower part as the system mount and interchangeable upper parts for the breech.

For example, military applications require particularly robust surfaces which can be provided by an appropriate upper part—in conjunction with appropriately designed other assemblies such as stocks etc., while hunting weapons are intended to provide the capability for surface treatment and decorations, which can be satisfied, for example by an upper part composed of plastic, army weapons are intended to be particularly light in weight, and this can be achieved, for example, by manufacture from aluminum, etc.; all of these aims can be achieved by one and the same lower part as a system mount in conjunction with different upper parts for breech guidance.

The modularity of the housing upper part and housing lower part and the capability to combine them as required makes it possible to reduce the number of different housings that need to be manufactured to a small number of basic types of upper parts and lower parts. This not only simplifies the storage and marketing logistics, but also the manufacturing process itself: splitting the housing in two simplifies the shaping and milling, since the two parts can each be manufactured separately, and the improved milling capability leads to less waste.

Furthermore, this results in the advantage that it is now no longer necessary to test the barrel and the breech separately for the official firing testing of a new weapon, to which all the parts which carry forces when a shot is fired must be subjected, since the upper part does not have any force-transmitting role when a shot is fired. This considerably simplifies the firing and type testing of new rifle types.

One particularly advantageous embodiment of the invention is distinguished in that the upper part can be connected to the lower part in a modular interchangeable manner. This allows the user himself, and even in the field, to assemble his rifle system in a modular form from different upper and lower parts, and barrel, stock, trigger, breech and magazine assemblies. Modular interchangeability has the additional advantage that, in the event of a housing defect, only the relevant housing parts need be replaced.

The modularization of the housing according to the invention provides the capability, according to one preferred embodiment, to make the upper part and the lower part from different materials. For example, this allows particularly robust materials to be used for the force-carrying lower part, and lower-cost materials to be used for the upper part, which does not carry any forces. Alternatively, because of the largely concealed installation of the lower part, particularly low-cost materials can be used for the lower part and particularly high-quality materials can be used for the externally visible upper part. Both combination options are within the scope of the present invention.

One particularly preferred material choice is to make the upper part from plastic and the lower part from metal. This combines high strength with the greatest possible cost saving.

In this context, it is particularly advantageous for the upper part to be machined, painted, coated and/or surface-treated at least on its outer surface. This makes it possible to comply with specific requirements with the aid of the upper part, on the basis of one and the same lower part.

The upper part may be connected to the lower part in any manner known from the prior art. According to one preferred refinement of the invention, the upper part is anchored to the lower part by means of a dovetail joint. This allows the upper part to be pushed onto the lower part when the weapon is assembled. By way of example, the dovetail joint can be fixed by securing screws or by interlocking attachment of the upper part between the barrel and the stock.

According to one preferred feature of the invention, the guide is an axial guide, which is known per se, for a bolt-action breech. Bolt-action breeches are autonomous, compact units which can therefore be guided in a simple manner in the upper part.

Further preferred features provide for the lower part to have a holder for a magazine, a third anchorage for a fore-end, and/or a fourth anchorage for side stock pieces or accessories. This allows a large number of different weapon types to be formed using the housing according to the invention.

BRIEF DESCRIPTION OF THE DRAWINGS

The invention will be explained in more detail in the following text with reference to one exemplary embodiment, which is illustrated in the attached drawings, in which.

DETAILED DESCRIPTION

Figure 1:
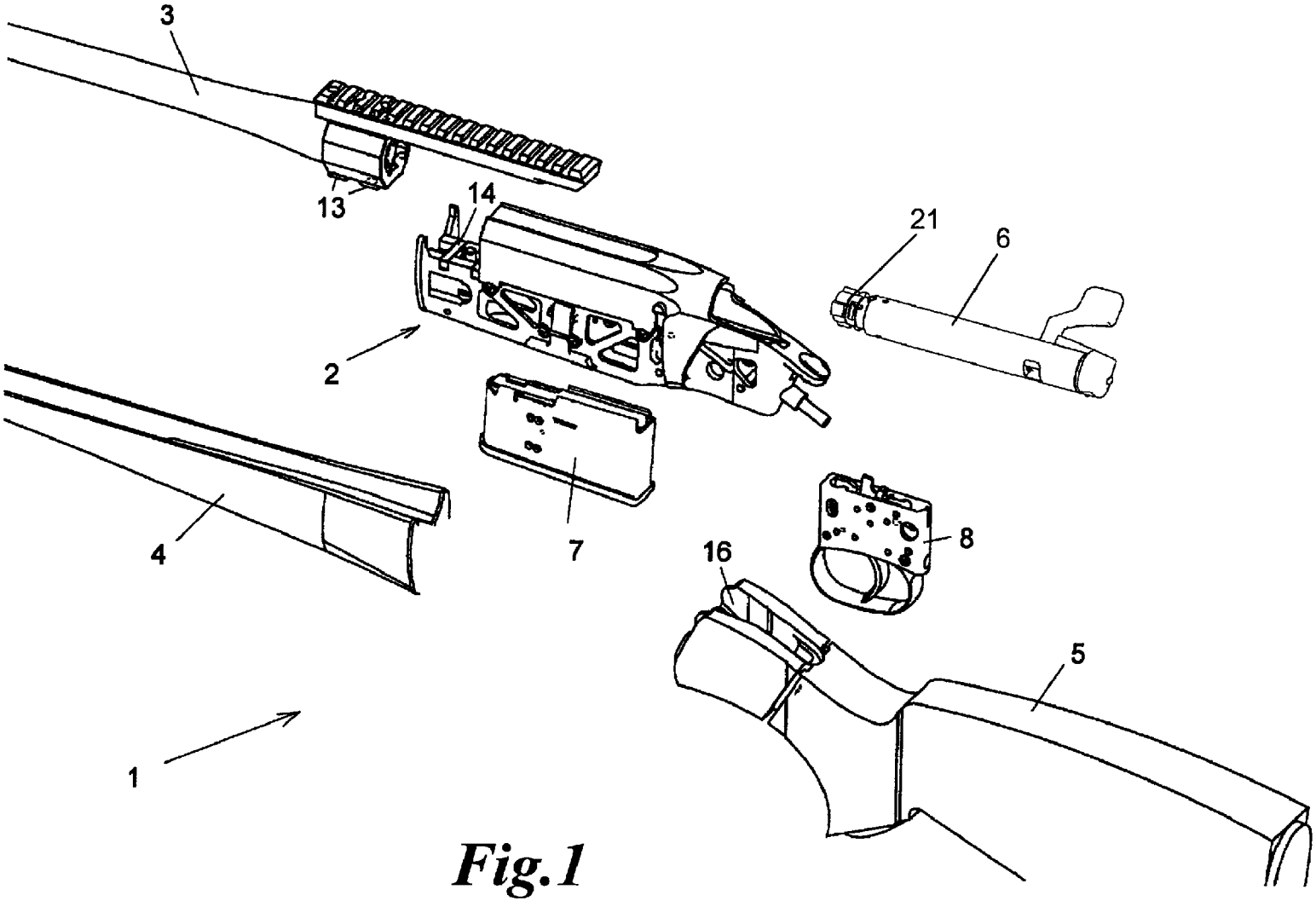
FIG. 1 shows a rifle, illustrated in the form of a detail, with a housing according to the invention, in the form of an exploded perspective view.

FIG. 1 shows a rifle 1 comprising modular assemblies which are mounted on or in a central housing 2. In detail, the assemblies are a barrel 3, a fore-end 4, a (rear) stock 5, a bolt-action breech 6, a magazine 7 and a modular trigger 8, as known by those skilled in the art.

Figure 2:
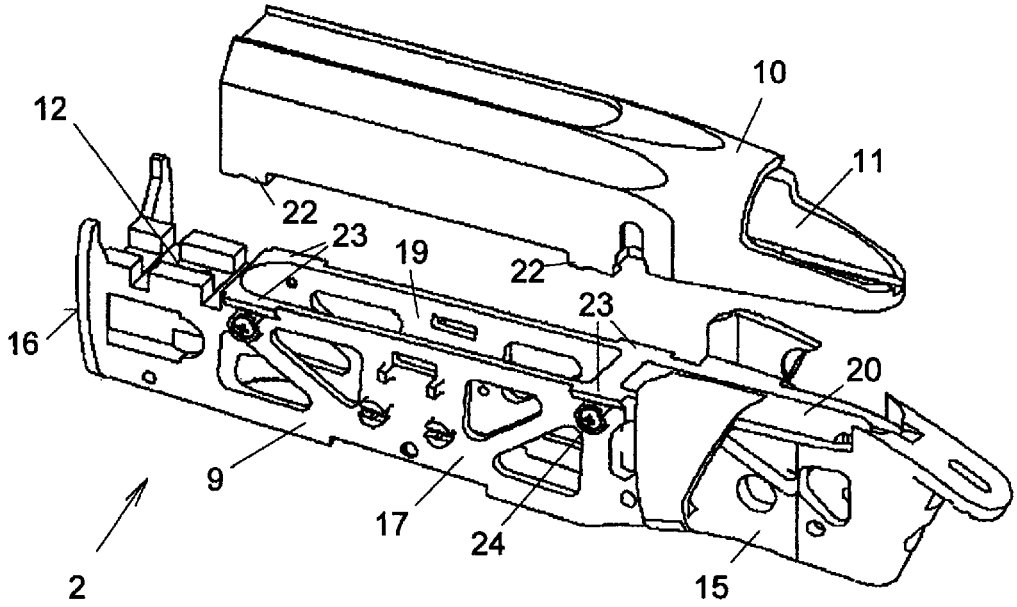
FIG. 2 shows an exploded perspective view of the housing according to the invention, in detail.

According to FIG. 2, the housing 2 is divided into a lower part 9 and an upper part 10, which is separate from the lower part 9 but can be firmly connected to the lower part 9. A guide 11 for the breech 6 is formed in the upper part 10, to be precise in the illustrated example in the form of a longitudinally running guide channel, which is open at the bottom, of a known type.

The lower part 9 is equipped with a first anchorage 12 for the barrel 3, to be more precise for barrel attachments 13 which are formed on the root of the barrel 3 and engage between latching bars 14 on the lower part 9 (FIG. 1). At its opposite end, the lower part 9 has a second anchorage 15 for the stock 5, for example in the form of a step in order to engage in a complementary recess 16 in the stock 5.

A third anchorage 16 for the fore-end 4, if provided, or a bipod etc. can optionally be provided in the area of the first anchorage 12 for the barrel 3. A fourth anchorage 17 for side stock pieces 18 (FIG. 3), if present, or accessories such as cartridge holders, rangefinders, camouflage equipment etc. can also be provided on both sides of the lower part 9, for example in the form of corresponding recesses or cutouts.

Finally, the lower part 9 is equipped in a manner known per se with a holder 19 for the magazine 7 and a holder 20 for the trigger 8. When assembled, the magazine 7 opens through the lower part 9 into the interior of the upper part 10 as can be seen when the breech is open.

When the breech 6 is closed, its front breech head 21 is locked like a bayonet fitting in the root of the barrel 3 and forms a rigid unit together with it when a shot is fired.

It has been found that, when in the locked state, the upper part 10 does not need to carry out any holding function for the breech 6, so that a different, for example less load-resistant material, can be chosen for the upper part 10 than for the lower part 9, which transmits forces from the barrel 3 to the stock 5. In consequence, depending on the requirement and the purpose, the lower part 9 and the upper part 10 can be made from different materials and with different surface qualities, paint finishes, surface treatments etc.

By way of example, the upper part 10 can be made of low-cost plastic, lightweight aluminum, etc. In contrast, the lower part 9 is preferably always made in one and the same form, for example from aluminum or steel. Numerous different weapon types can be produced with a small number of basic components by combination of appropriate upper parts 10 with appropriate lower parts 9.

Figure 3:
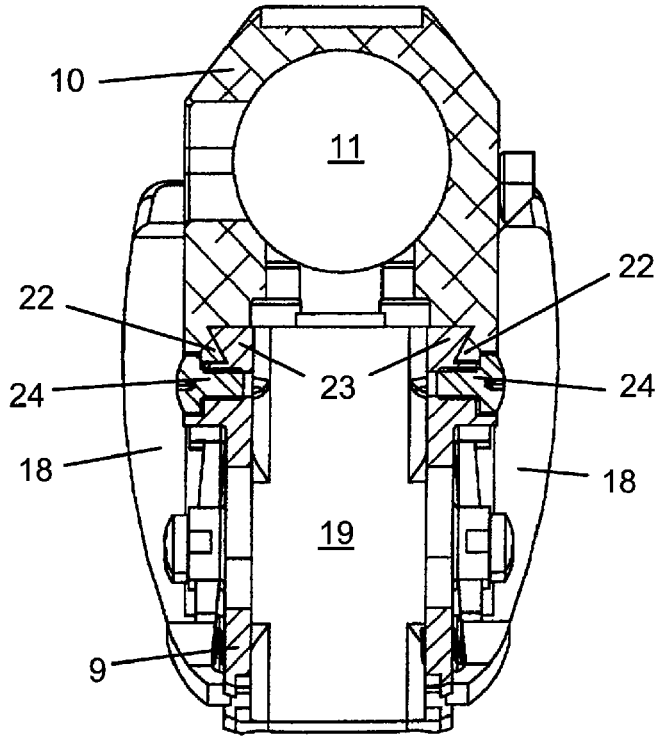
FIG. 3 shows a cross-section through the housing according to the invention, with side stock pieces fitted.

FIG. 3 shows the anchorage of the upper part 10 to the lower part 9 via a detachable dovetail joint. The dovetail joint has appropriate attachments 22 on the upper part 10, and complementary attachments 23 on the lower part 9.

The attachments 22, 23 for the dovetail joint extend over only a portion of the length of the upper part 10 and lower part 9, so that the upper part 10 can be placed on the lower part 9 with an offset, and can then be moved in the axial direction in order to make the attachments 22, 23 engage. In the engaged position, the dovetail joint can be fixed, for example, by means of fixing screws 24, or the upper part 10 is simply fixed between the barrel 3 and the lower part 9 during assembly.

The invention is not restricted to the described exemplary embodiments but covers all variants and modifications which are within the scope of the attached claims.

The invention claimed is:

1. A rifle, comprising:

a detachable barrel, a detachable stock, a removable breech being lockable to the barrel, and a detachable trigger which interacts with the breech, a housing divided into a lower part and an upper part, the upper part being a separate component from the lower part, the upper part and lower part being detachably connectable together, the lower part including portions which provide direct anchorages for detachably connecting the barrel and the stock and a portion including the holder for the trigger, the upper part including a guide channel for receiving the removable breech, wherein the upper part and the lower part are made of different materials such that the lower part is made from a sturdy, load bearing material for transmitting forces from the barrel to the stock and the upper part is made from a material having less load bearing strength than the lower part material.

2. The rifle as claimed in claim 1, wherein the upper part is connected to the lower part in a modular interchangeable manner.

3. The as claimed in claim 2, wherein the barrel, stock, trigger and breech are mounted in an interchangeable manner to the housing.

4. The rifle as claimed in claim 1, wherein the upper part is made of plastic and the lower part is made of metal.

5. The rifle as claimed in claim 4, wherein the upper part is machined, painted, coated or surface-treated at least on its outer surface.

6. The rifle as claimed in claim 1, wherein the upper part is connected to the lower part by means of a dovetail joint.

7. The rifle as claimed in claim 1, wherein the guide channel is an axial guide for a removable bolt-action breech in which the bolt-action breech includes a breech head which is lockable to a root end of the barrel.

8. The rifle as claimed in claim 1, wherein the lower part has a holder for a magazine.

9. The rifle as claimed in claim 1, wherein the lower part has a third anchorage for a fore-end.

10. The rifle as claimed in claim 9, wherein the lower part has a fourth anchorage for side stock pieces or accessories.

11. A housing system for a rifle having interchangeable components comprising:

a lower part which supports the housing system, the lower part including a first anchorage at a fore-end for directly mounting a detachable barrel to the lower part, a second anchorage at a rear-end for mounting a detachable stock to the lower part, and a holder for a detachable trigger;

a detachable trigger mounted in the holder;

a removable breech operatively coupled to the detachable trigger, and an upper part including a guide channel for receiving the removable breech and guiding the breech into lockable engagement with a root end of the barrel, wherein the upper part and lower part are separate components which are detachably connectable together to form the housing system, and further wherein each of the barrel, stock, trigger and breech components may be detached from the housing system and reattached thereto or replaced with a different component.

12. The housing as claimed in claim 1, wherein each of the upper part and the lower part are each formed as a single component of the housing system.

13. The housing as claimed in claim 11, wherein the upper part and the lower part are made of different materials such that the lower part is made from a sturdy, load bearing material for transmitting forces from the barrel to the stock and the upper part is made from a material having less load bearing strength than the lower part material.

14. The housing as claimed in claim 13, wherein the upper part is made of plastic and the lower part is made of metal.

15. The housing as claimed in claim 14, wherein the upper part is machined, painted, coated or surface-treated at least on its outer surface.

16. The housing as claimed in claim 11, wherein the upper part is connected to the lower part by means of a dovetail joint.

17. The housing as claimed in claim 11, wherein the guide channel is an axial guide for a bolt-action breech in which the bolt-action breech includes a breech head which is lockable to a root end of the barrel.

18. The housing as claimed in claim 11, wherein the lower part has a holder for a magazine.

19. The housing as claimed in claim 11, wherein the lower part has a third anchorage for the fore-end.

20. The housing as claimed in claim 19, wherein the lower part has a fourth anchorage for side stock pieces or accessories.

* * * * *

UNITED STATES PATENT AND TRADEMARK OFFICE

CERTIFICATE OF CORRECTION

PATENT NO. : 8,028,458 B2
APPLICATION NO. : 12/066659
DATED : October 4, 2011
INVENTOR(S) : Hermann Rohrauer It is certified that error appears in the above-identified patent and that said Letters Patent is hereby corrected as shown below:

Column 5, line 1:

Claim 12:

Now reads: "The housing as claimed in claim 1, wherein..."

Should read: -- The housing as claimed in claim 11, wherein --

Signed and Sealed this
Sixth Day of December, 2011

David J. Kappos
*Director of the United States Patent and Trademark Office*